US012467236B2

(12) United States Patent
Yamanobe et al.

(10) Patent No.: US 12,467,236 B2
(45) Date of Patent: Nov. 11, 2025

(54) WORK MACHINE

(71) Applicant: Hitachi Construction Machinery Co., Ltd., Tokyo (JP)

(72) Inventors: Yousuke Yamanobe, Ushiku (JP); Hidenobu Tsukada, Ushiku (JP); Yuuki Gotou, Tsuchiura (JP); Atsushi Kanda, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 513 days.

(21) Appl. No.: 17/435,130

(22) PCT Filed: Sep. 2, 2020

(86) PCT No.: PCT/JP2020/033331

§ 371 (c)(1),
(2) Date: Aug. 31, 2021

(87) PCT Pub. No.: WO2021/054125

PCT Pub. Date: Mar. 25, 2021

(65) Prior Publication Data

US 2022/0145590 A1 May 12, 2022

(30) Foreign Application Priority Data

Sep. 17, 2019 (JP) ..... 2019-168804

(51) Int. Cl.
*E02F 9/26* (2006.01)
*E02F 9/20* (2006.01)
*E02F 9/24* (2006.01)

(52) U.S. Cl.
CPC ..... *E02F 9/24* (2013.01); *E02F 9/2004* (2013.01); *E02F 9/2066* (2013.01); *E02F 9/267* (2013.01)

(58) Field of Classification Search
CPC ..... E02F 3/435; E02F 3/437; E02F 9/2004; E02F 9/2066; E02F 9/207; E02F 9/2246; E02F 9/24; E02F 9/26; G01M 17/007
See application file for complete search history.

(56) References Cited

U.S. PATENT DOCUMENTS 8,682,525 B1 * 3/2014 Kalinadhabhotla ..... G06F 7/00 340/442
2010/0064677 A1 * 3/2010 Kawaguchi ..... E02F 9/2075 318/446

(Continued)

FOREIGN PATENT DOCUMENTS

EP 2 657 411 A2 10/2013
JP 5-187968 A 7/1993

(Continued)

OTHER PUBLICATIONS

International Search Report (PCT/ISA/210) issued in PCT Application No. PCT/JP2020/033331 dated Nov. 17, 2020 with English translation (five (5) pages).

(Continued)

*Primary Examiner* — Fadey S. Jabr
*Assistant Examiner* — Michael J Herrera
(74) *Attorney, Agent, or Firm* — Crowell & Moring LLP

(57) ABSTRACT

A work machine includes: a work device; an operation device operating the work device; a first controller controlling operation of the work device on the basis of operation of the operation device; and a second controller determining that an auto idle condition is satisfied and performing auto idle control that decreases an engine revolution speed to an idle revolution speed in case the operation device is not operated for a predetermined time. The first controller diagnoses presence or absence of a failure in the first controller when supply of power to the first controller is started. The second controller performs power interruption (Continued)

control that interrupts the supply of the power to the first controller in case the auto idle condition is satisfied, and performs power supply control that starts the supply of the power to the first controller afterward.

5 Claims, 11 Drawing Sheets

(56) References Cited

U.S. PATENT DOCUMENTS

| | | | | |
|---|---|---|---|---|
| 2010/0149716 | A1* | 6/2010 | Bakken | E02F 9/2095 361/143 |
| 2011/0093150 | A1* | 4/2011 | Yanagisawa | B60K 6/365 180/65.225 |
| 2012/0205969 | A1* | 8/2012 | Yabuuchi | F02D 29/06 307/9.1 |
| 2013/0304332 | A1 | 11/2013 | Kim et al. | |
| 2015/0299985 | A1* | 10/2015 | Takehara | B60K 1/00 903/904 |
| 2016/0281329 | A1* | 9/2016 | Shang | E02F 9/128 |
| 2016/0290369 | A1* | 10/2016 | Opdenbosch | F02D 29/04 |
| 2018/0229786 | A1* | 8/2018 | Weaver | B62D 63/08 |
| 2021/0180293 | A1* | 6/2021 | Ishijima | E02F 9/2075 |

FOREIGN PATENT DOCUMENTS

| | | | |
|---|---|---|---|
| JP | 9-195833 | A | 7/1997 |
| JP | 2003-200822 | A | 1/2003 |
| JP | 2005-138751 | A | 6/2005 |
| JP | 2005-226493 | A | 8/2005 |
| JP | 2016-132967 | A | 7/2016 |
| JP | 2017-187002 | A | 10/2017 |
| KR | 10-2013-0087661 | A | 8/2013 |

OTHER PUBLICATIONS

Japanese-language Written Opinion (PCT/ISA/237) issued in PCT Application No. PCT/JP2019/033331 dated Nov. 17, 2020 (three (3) pages).

Korean-language Office Action issued in Korean Application No. 10-2021-7025663 dated Dec. 21, 2022 with English translation (10 pages).

International Preliminary Report on Patentability (PCT/IB/338 & PCT/IB/373) issued in PCT Application No. PCT/JP2020/033331 dated Mar. 31, 2022, including English translation of document C2 (Japanese-language Written Opinion (PCT/ISA/237), filed on Aug. 31, 2021) (five (5) pages).

* cited by examiner

WORK MACHINE

TECHNICAL FIELD

The present invention relates to a work machine.

BACKGROUND ART

A control system is known which includes a controller, a sensor, or the like that has a self-diagnosing function of diagnosing the presence or absence of an own abnormality when power is turned on. Patent Document 1 discloses a control system for a vehicle, the control system including a sensor having a self-diagnosing function and a power interrupting unit that can interrupt supply of power to the sensor. In the control system described in Patent Document 1, the power supply to the sensor is interrupted when a brake operation is performed and the vehicle is set in a stopped state, and the self-diagnosis of the sensor is performed by performing the power supply to the sensor afterward.

PRIOR ART DOCUMENT

Patent Document

Patent Document 1: JP-2003-200822-A

SUMMARY OF THE INVENTION

Problem to be Solved by the Invention

A work machine such as a hydraulic excavator or the like performs work such as excavation or the like by a work device when a machine body is in a stopped state in which travelling operation is stopped. Therefore, when power supply to the controller having a self-diagnosing function is interrupted while the machine body is in the stopped state in which travelling operation is stopped, work using the work device may be hindered, and work efficiency may be decreased.

It is an object of the present invention to provide a work machine in which self-diagnosis of a controller can be performed at an appropriate frequency without decreasing efficiency of work using a work device.

Means for Solving the Problem

A work machine according to one aspect of the present invention includes: a work device; an operation device operating the work device; a first controller configured to control operation of the work device on the basis of operation of the operation device; and a second controller configured to determine that an auto idle condition is satisfied and perform auto idle control that decreases an engine revolution speed to an idle revolution speed in case the operation device is not operated for a predetermined time. The first controller is configured to diagnose presence or absence of a failure in the first controller when supply of power to the first controller is started. The second controller is configured to perform power interruption control that interrupts the supply of the power to the first controller in case the auto idle condition is satisfied, and perform power supply control that starts the supply of the power to the first controller afterward.

Advantages of the Invention

According to the present invention, it is possible to provide a work machine in which self-diagnosis of a first controller can be performed at an appropriate frequency without decreasing efficiency of work using a work device.

MODES FOR CARRYING OUT THE INVENTION

Work machines according to embodiments of the present invention will be described with reference to the drawings.

First Embodiment

Figure 1:
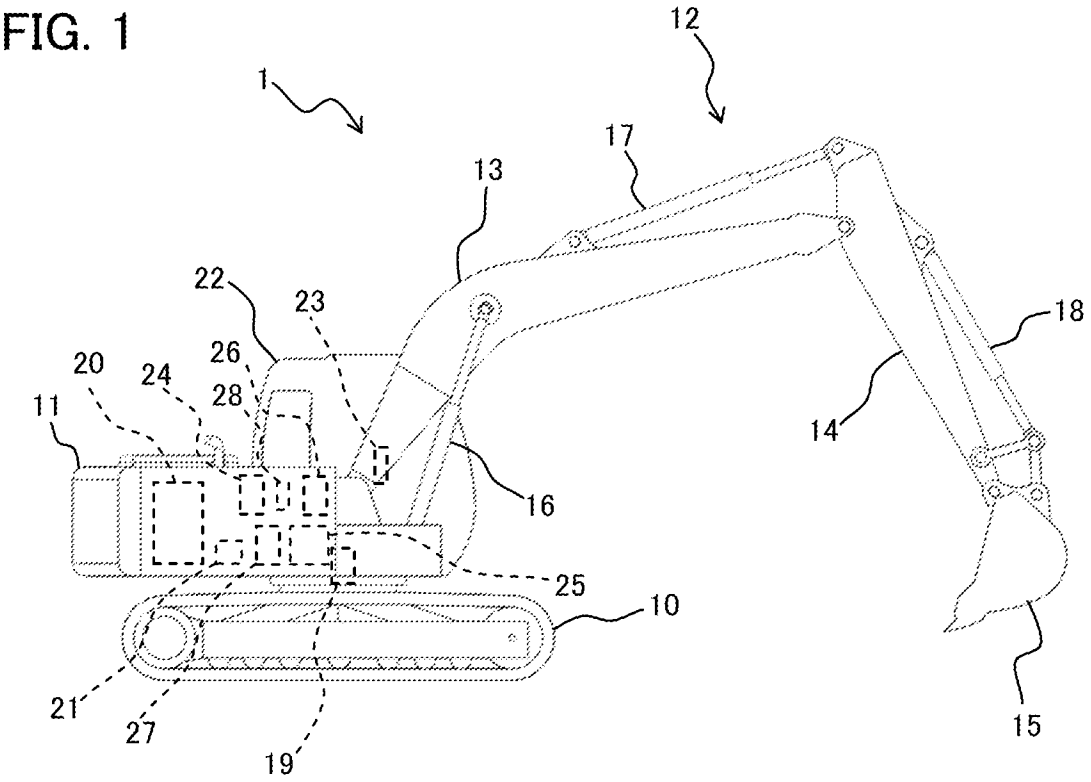
FIG. 1 is a side view showing a configuration of a hydraulic excavator as an example of a work machine.

FIG. 1 is a side view showing a configuration of a hydraulic excavator 1 as an example of a work machine. In the hydraulic excavator 1, various kinds of actuators are driven by a hydraulic operating fluid delivered from a hydraulic pump (not shown) to perform various work.

As shown in FIG. 1, the hydraulic excavator 1 includes a track structure 10, a swing structure 11 swingably provided on the track structure 10, and a front work device 12 provided to the swing structure 11. The track structure 10 travels with a pair of left and right crawlers driven by a travelling motor. The swing structure 11 is swung by a swing motor 19.

A cab 22 is provided on the left side of a front portion of the swing structure 11. An engine compartment is provided to a rear portion of the cab 22. Provided within the cab 22 are a cab seat on which an operator is seated and an operation lever 23 as an operation device for operating the front work device 12. The operation lever 23 is provided with an operation sensor 23*a* (see FIG. 2) such as a potentiometer or the like that detects an operation (an operation direction and an operation amount) of the operation lever 23. In addition, an engine control dial 20*a* (see FIG. 2) for setting an engine revolution speed (revolution speed per minute) is provided within the cab 22. The engine control dial 20*a* is an operation device that sets a target value (command value) of the revolution speed of an engine 20. The engine control dial 20*a* is operated by the operator of the hydraulic excavator 1.

The engine compartment houses the engine 20 as a power source, a battery 21 that supplies power to a machine body, hydraulic apparatuses, and the like. As the hydraulic apparatuses, there are hydraulic pumps (a main pump and a pilot pump) driven by the engine 20, a control valve that controls a flow of hydraulic operating fluid delivered from the hydraulic pumps, a proportional valve unit 25 that outputs a pilot pressure to a pressure receiving chamber of the control valve (see FIG. 2), and the like. A counterweight for balancing the machine body during work is attached to a rear portion of the engine compartment.

The front work device 12 is provided to the right side of a front portion of the swing structure 11. The front work device 12 includes a plurality of front implement members, that is, a boom 13, an arm 14, and a bucket 15. A proximal end of the boom 13 is rotatably attached to a front portion of the swing structure 11. A proximal end of the arm 14 is rotatably attached to a distal end of the boom 13. The boom 13 and the arm 14 rise and fall by being driven by a boom cylinder 16 and an arm cylinder 17, respectively. The bucket 15 is attached to a distal end of the arm 14 so as to be vertically rotatable with respect to the arm 14. The bucket 15 is driven by a bucket cylinder 18.

Figure 2:
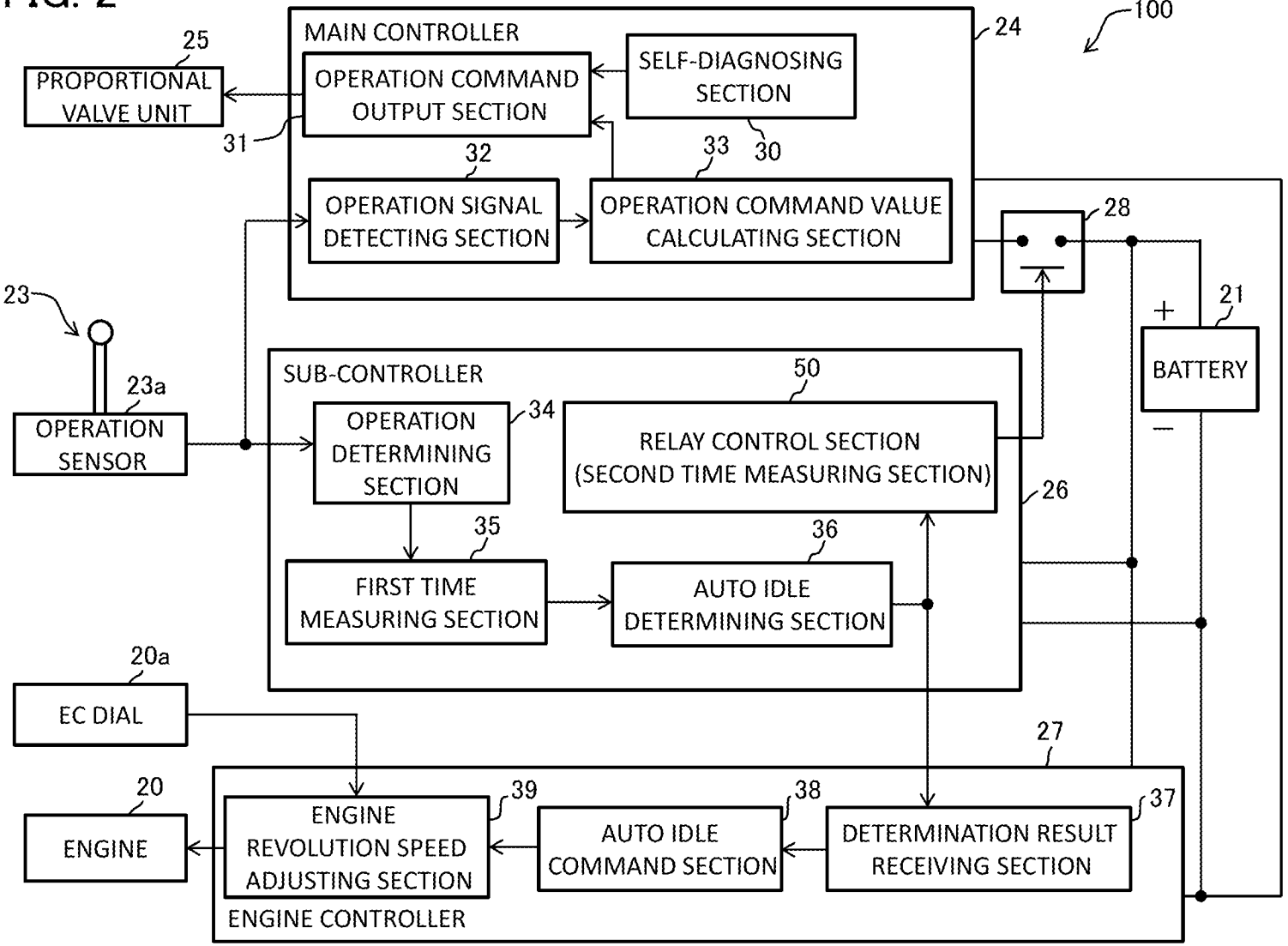
FIG. 2 is a functional block diagram of assistance in explaining a configuration of a control system of the hydraulic excavator according to a first embodiment.

FIG. 2 is a functional block diagram of assistance in explaining a configuration of a control system 100 of the hydraulic excavator 1. The control system 100 of the hydraulic excavator 1 includes a plurality of controllers 24, 26, and 27 and the battery 21 that supplies power to each of the controllers 24, 26, and 27. Each of the controllers 24, 26, and 27 is constituted by a microcomputer including a CPU (Central Processing Unit) as an operation circuit and a ROM (Read Only Memory) and a RAM (Random Access Memory) as a storage device as well as an input-output interface (I/O interface) and other peripheral circuits. The controllers 24, 26, and 27 control various parts of the hydraulic excavator 1. The storage devices of the controllers 24, 26, and 27 store a program capable of performing various kinds of calculations. That is, the storage devices of the controllers 24, 26, and 27 are storage media from which programs implementing functions of the present embodiment are readable.

The main controller 24 controls operation of each hydraulic cylinder (16, 17, 18) of the front work device 12 or the like on the basis of operation of the operation lever 23. The engine controller 27 sets a target engine revolution speed on the basis of a command value of the engine control dial 20*a* or the like, and controls the engine 20 such that an actual revolution speed of the engine 20 becomes the set target engine revolution speed. The sub-controller 26 outputs an auto idle activating command for performing auto idle control that controls the engine revolution speed to an idle revolution speed to the engine controller 27 when an auto idle condition to be described later is satisfied. When the auto idle activating command is input to the engine controller 27, the engine controller 27 sets the idle revolution speed as the target engine revolution speed, and controls the engine 20 such that the actual revolution speed of the engine 20 becomes the idle revolution speed.

The proportional valve unit 25 is connected to the main controller 24. The proportional valve unit 25 includes a plurality of solenoid proportional valves capable of adjusting the opening degree of a valve according to an operation command (control current) from the main controller 24. The main controller 24 outputs, to the solenoid of a solenoid proportional valve corresponding to an operated operation lever 23 and the operation direction of the operation lever 23, an operation command (control current) corresponding to the operation angle (operation amount) of the operation lever 23.

Each solenoid proportional valve provided in the proportional valve unit 25 reduces the delivery pressure of a pilot pump (not shown) driven by the engine 20, and outputs the reduced pressure as a pilot pressure to the pressure receiving chamber of the control valve. The control valve is provided between a main pump (not shown) driven by the engine 20 and each hydraulic cylinder (16, 17, 18), and controls a flow of hydraulic operating fluid supplied from the main pump to each hydraulic cylinder (16, 17, 18). A spool of the control valve operates when the pilot pressure corresponding to the operation amount of the operation lever 23 is output from the proportional valve unit 25 and the pilot pressure acts on the pressure receiving chamber of the control valve. Consequently, the hydraulic operating fluid is introduced from the main pump into a bottom chamber or a rod chamber of the hydraulic cylinder (16, 17, 18), and the hydraulic cylinder expands or contracts. Hence, the hydraulic cylinder (16, 17, 18) performs operation (expansion/contraction) corresponding to the operation direction of the operation lever 23 at a speed corresponding to the operation angle (operation amount).

As shown in FIG. 2, the operation sensor 23*a* of the operation lever 23 is connected to the main controller 24, and an operation signal detected by the operation sensor 23*a* is input to the main controller 24. The main controller 24 includes: an operation signal detecting section 32 that detects the operation signal (voltage value) indicating the operation direction and operation amount of the operation lever 23; an operation command value calculating section 33 that calculates a current value (operation command value) of a control current to be output to the proportional valve unit 25 on the basis of the operation signal of the operation lever 23, which is detected by the operation signal detecting section 32; an operation command output section 31 that outputs the control current (operation command) having the current value (operation command value) calculated by the operation command value calculating section 33 to the proportional valve unit 25; and a self-diagnosing section 30 that diagnoses the presence or absence of an own failure (abnormality). Details of the self-diagnosing section 30 will be described later.

Figure 3:
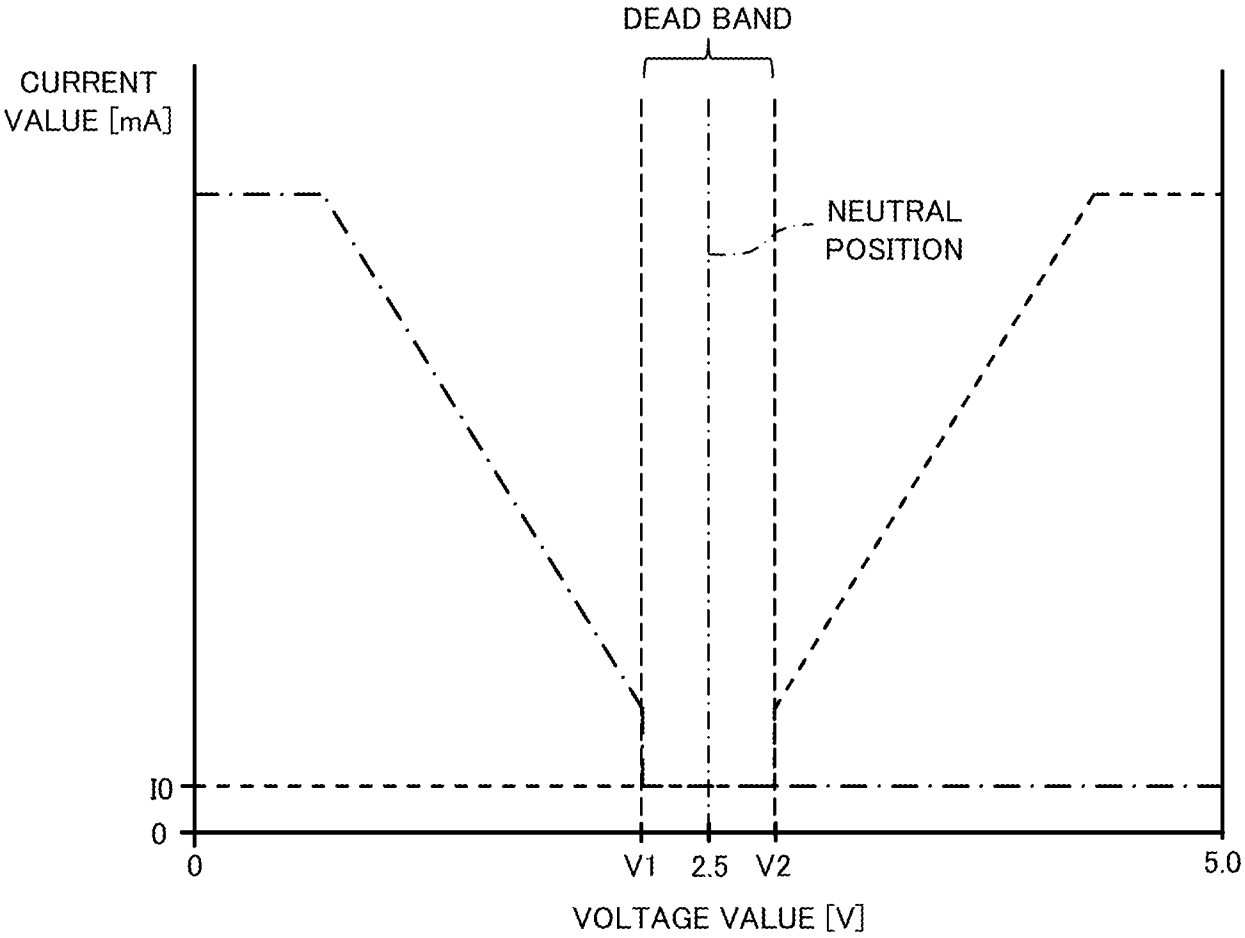
FIG. 3 is a diagram showing a conversion table used when an operation command value calculating section calculates a current value (operation command value).

FIG. 3 is a diagram showing a conversion table used when the operation command value calculating section 33 calculates the current value (operation command value). The storage device of the main controller 24 stores the conversion table shown in FIG. 3 in the form of a look-up table. The conversion table is a table in which the current value (axis of ordinates) is set according to the voltage value (axis of abscissas).

The operation signal detecting section 32 detects a voltage value of 0 [V] to 5.0 [V] as the operation signal indicating the operation direction and the operation amount from the operation sensor 23*a* of the operation lever 23. The operation command value calculating section 33 refers to the conversion table shown in FIG. 3, and calculates the current value corresponding to the voltage value detected by the operation signal detecting section 32.

In the present embodiment, the operation sensor 23*a* outputs a voltage of 2.5 [V] when the operation lever 23 is in a neutral position. The operation sensor 23*a* outputs a voltage equal to or higher than V1 and lower than V2 (0<V1<2.5 and 2.5<V2<5.0) when the operation lever 23 is in a dead band. As the voltage value output from the operation sensor 23*a*, when the operation lever 23 is operated to one side beyond the dead band, the output voltage value increases according to an increase in the operation amount. When the operation lever 23 is operated to a maximum operation position on the one side (when the operation lever 23 is operated fully), the operation sensor 23*a* outputs a voltage of 5.0 [V]. In addition, as the voltage value output from the operation sensor 23*a*, when the operation lever 23 is operated to another side beyond the dead band, the output voltage value decreases according to an increase in the operation amount. When the operation lever 23 is operated to a maximum operation position on the other side (when the operation lever 23 is operated fully), the operation sensor 23*a* outputs a voltage of 0 [V].

When the operation lever 23 is in the dead band, the operation command output section 31 outputs a standby current (a current value of 10 [mA]). When the operation lever 23 is operated to the one side beyond the dead band, the current value (operation command value) of the control current output by the operation command output section 31 increases according to an increase in the operation amount (increase in the voltage value). Similarly, when the operation lever 23 is operated to the other side beyond the dead band, the current value (operation command value) of the control current output by the operation command output section 31 increases according to an increase in the operation amount (decrease in the voltage value).

When the control current (exciting current) output from the operation command output section 31 is input to the solenoid of the solenoid proportional valve of the proportional valve unit 25, the opening degree of the valve is controlled according to the current value of the control current. The larger the current value of the control current, the larger the opening degree of the solenoid proportional valve. When the solenoid proportional valve is opened, a pilot pressure is introduced into the pressure receiving chamber of the control valve, the opening degree of the control valve is adjusted according to the pilot pressure, and thus the pressure of the hydraulic operating fluid actuating the hydraulic actuator (for example the boom cylinder 16) is adjusted.

As shown in FIG. 2, the operation sensor 23*a* of the operation lever 23 is connected to the sub-controller 26, and an operation signal from the operation sensor 23*a* is input to the sub-controller 26. The sub-controller 26 includes an operation determining section 34, a first time measuring section 35, an auto idle determining section 36, and a relay control section 50. Details of the relay control section 50 will be described later.

The operation determining section 34 determines whether or not the operation lever 23 is operated. The operation determining section 34 determines that the operation lever 23 is not operated when a signal indicating that the operation lever 23 is in the dead band (the voltage value shown in FIG. 3 is equal to or higher than V1 and lower than V2) is input. The operation determining section 34 determines that the operation lever 23 is operated when a signal indicating that the operation lever 23 is operated beyond the dead band (the voltage value shown in FIG. 3 is lower than V1 or equal to or higher than V2) is input.

The first time measuring section 35 measures time by a first timer (not shown) included in the sub-controller 26 when the operation determining section 34 determines that the operation lever 23 is not operated. The first time measuring section 35 resets the first timer and sets a measured time T1 to 0 (zero) when the operation determining section 34 determines that the operation lever 23 is operated. That is, the first time measuring section 35 measures the time (non-operation time) T1 for which the operation lever 23 is continuously not operated.

The auto idle determining section 36 determines whether or not the auto idle condition is satisfied on the basis of a result of determination of the operation determining section 34 and a result of measurement in the first time measuring section 35. Specifically, when it is determined that the front work device 12 is operated, the auto idle determining section 36 determines that the auto idle condition is not satisfied, and outputs an auto idle clearing command. In addition, the auto idle determining section 36 determines whether or not the time T1 measured by the first time measuring section 35 has passed a predetermined time Tt1. When the time T1 measured by the first time measuring section 35 is less than the predetermined time Tt1, the auto idle determining section 36 determines that the auto idle condition is not satisfied, and outputs the auto idle clearing command. When the time T1 measured by the first time measuring section 35 is equal to or more than the predetermined time Tt1, the auto idle determining section 36 determines that the auto idle condition is satisfied, and outputs the auto idle activating command. The predetermined time Tt1 is a threshold value for determining that the auto idle condition is satisfied. The predetermined time Tt1 can be set optionally. The predetermined time Tt1 is stored in the storage device of the sub-controller 26 in advance.

The engine controller 27 includes a determination result receiving section 37, an auto idle command section 38, and an engine revolution speed adjusting section 39. A signal indicating a result of determination by the auto idle determining section 36 (auto idle activating command/auto idle clearing command) is input to the determination result receiving section 37. The auto idle command section 38 sets the target revolution speed of the engine 20 to an auto idle revolution speed, and outputs a signal indicating the target revolution speed (auto idle revolution speed) to the engine revolution speed adjusting section 39 when the auto idle activating command is input to the determination result receiving section 37. The engine revolution speed adjusting section 39 outputs, to the engine 20, a revolution speed command signal for making the actual revolution speed of the engine 20 the target revolution speed (auto idle revolution speed).

The auto idle command section 38 does not output the signal indicating the value of the target revolution speed (auto idle revolution speed) to the engine revolution speed adjusting section 39 when the auto idle clearing command is input to the determination result receiving section 37. In this case, the engine revolution speed adjusting section 39 outputs a predetermined revolution speed command signal corresponding to a normal operation state to the engine 20 on the basis of the target revolution speed set by the engine control dial 20*a* or the like.

Thus, in the present embodiment, the main controller 24 functions as a first controller that controls the operation of the front work device 12 on the basis of an operation of the operation lever 23. In addition, the sub-controller 26 and the engine controller 27 function as a second controller that performs auto idle control that, in case the operation lever 23 is not operated for the predetermined time Tt1, determines that the auto idle condition is satisfied, and decreases the engine revolution speed to the idle revolution speed lower than the target revolution speed set by the engine control dial 20*a*.

The battery 21 is connected to power supply circuits (not shown) of the main controller 24, the sub-controller 26, and the engine controller 27. A lead storage battery, which is common as an electrical storage device that stores charge, for example, is used as the battery 21. When the operator turns on an ignition switch, power is supplied from the battery 21 to each of the controllers 24, 26, and 27.

Description will next be made of a self-diagnosing function possessed by the main controller 24 and control based on a diagnosis result of the self-diagnosing function. The main controller 24 has the self-diagnosing function of diagnosing the presence or absence of a failure in itself (the main controller 24) when the supply of power to itself (the main controller 24) is started.

When the operator turns on the ignition switch, and thereby turns on power, the self-diagnosing section 30 of the main controller 24 performs failure diagnosis (abnormality diagnosis) on electronic apparatuses (not shown) such as the CPU of the main controller 24 and various kinds of I/Os. When the self-diagnosis detects a failure (abnormality), the self-diagnosing section 30 outputs, to the operation command output section 31, a command to inhibit the output of the operation command (control current) to the proportional valve unit 25. Hence, in this case, the front work device 12 does not operate even when the operation lever 23 is operated beyond the dead band.

When the self-diagnosis does not detect any failure, the self-diagnosing section 30 does not output, to the operation command output section 31, the command to inhibit the output of the operation command (control current) to the proportional valve unit 25. That is, the self-diagnosing section 30 permits the output of the operation command (control current) from the operation command output section 31 to the proportional valve unit 25. Hence, in this case, as described above, the operation command output section 31 outputs the operation command (control current) corresponding to the operation command value (control current value) calculated by the operation command value calculating section 33 to the proportional valve unit 25 on the basis of the operation signal of the operation lever 23, which is detected by the operation signal detecting section 32. Therefore, the front work device 12 operates according to the operation of the operation lever 23.

Here, the following problems occur when the supply of power to the main controller 24 is interrupted on condition only that the track structure 10 is in a stop state, and thereafter the failure self-diagnosis of the main controller 24 is performed by supplying power to the main controller 24. The work machine such as the hydraulic excavator 1 performs work such as excavation or the like by a work device such as the front work device 12 in a state in which the track structure 10 is stopped. Hence, in the work machine, if the supply of power to the main controller 24 is interrupted when the state in which the track structure 10 is stopped is detected, work using the front work device 12 may be hindered, and work efficiency may be decreased. For example, in the hydraulic excavator 1 according to the present embodiment, if the supply of power to the main controller 24 is interrupted when the state in which the track structure 10 is stopped is detected, the main controller 24 cannot detect the operation signal of the operation lever 23, nor can output the operation command to the proportional valve unit 25. That is, a quick transition to work using the front work device 12 cannot be made after the track structure 10 is stopped.

Accordingly, in the present embodiment, in a state in which there is no intention of work using the front work device 12, that is, when the auto idle condition is satisfied, the power supplied to the main controller 24 is interrupted, and the self-diagnosis is performed afterward by supplying the power to the main controller 24. Details will be described in the following.

The hydraulic excavator 1 according to the present embodiment has a relay 28 provided to a power line that connects the battery 21 and the power supply circuit of the main controller 24 to each other. The relay 28 functions as a power interrupting unit capable of interrupting the supply of power from the battery 21 to the main controller 24 on the basis of a command from the sub-controller 26. When a conduction signal is input from the sub-controller 26 to the relay 28, the relay 28 is set in a conduction state (closed state), and permits the supply of power from the battery 21 to the main controller 24. When an interruption signal is input from the sub-controller 26 to the relay 28, the relay 28 is set in an interrupting state (opened state), and interrupts the supply of power from the battery 21 to the main controller 24.

The relay control section 50 of the sub-controller 26 controls the conduction/interruption of the relay 28 on the basis of a result of determination by the auto idle determining section 36. The relay control section 50 outputs the conduction signal for setting the relay 28 in the conduction state to the relay 28 when the auto idle determining section 36 determines that the auto idle condition is not satisfied. The relay control section 50 outputs the interruption signal for setting the relay 28 in the interrupting state to the relay 28 when the auto idle determining section 36 determines that the auto idle condition is satisfied.

In addition, the relay control section 50 has a function as a second time measuring section that starts measuring time by a second timer (not shown) included in the sub-controller 26 when the auto idle determining section 36 determines that the auto idle condition is satisfied. The relay control section (second time measuring section) 50 resets the second timer and sets a measured time T2 to 0 (zero) when the auto idle determining section 36 determines that the auto idle condition is not satisfied. That is, the relay control section (second time measuring section) 50 measures a time for which the interruption signal is continuously output (power interruption time).

The relay control section 50 further determines whether or not the measured time T2 has passed a predetermined time Tt2. The relay control section 50 outputs the interruption signal for setting the relay 28 in the interrupting state to the relay 28 when the measured time T2 is less than the predetermined time Tt2. The relay control section 50 outputs the conduction signal for setting the relay 28 in the conduction state to the relay 28 when the measured time T2 is equal to or more than the predetermined time Tt2. The predetermined time Tt2 is a time for which the supply of power to the main controller 24 is interrupted (for example, about 500 ms). The predetermined time Tt2 can be set optionally. The predetermined time Tt2 is stored in the storage device of the sub-controller 26 in advance.

Thus, the sub-controller 26 performs power interruption control that interrupts the supply of power from the battery 21 to the main controller 24 when the auto idle condition is satisfied, and performs power supply control that starts the supply of power from the battery 21 to the main controller 24 afterward.

Figure 4:
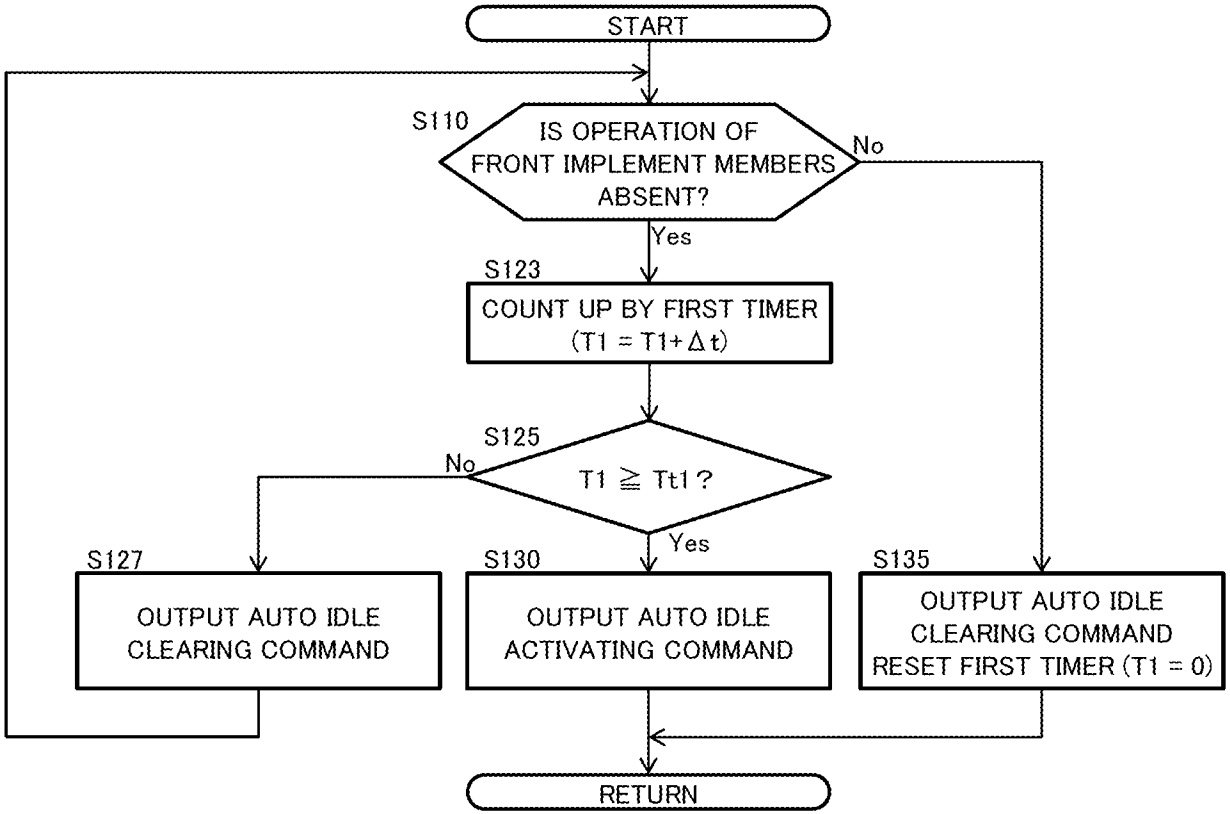
FIG. 4 is a flowchart illustrating an example of processing contents of auto idle determination control by a sub-controller in the hydraulic excavator according to the first embodiment.

FIG. 4 is a flowchart illustrating an example of processing contents of auto idle determination control by the sub-controller 26 in the hydraulic excavator 1 according to the first embodiment. The processing shown in this flowchart is, for example, started by turning on the ignition switch not shown, and is repeatedly performed in a predetermined control cycle after an initial setting not shown is made.

In step S110, the sub-controller 26 determines whether or not an operation for operating front implement members (the boom 13, the arm 14, and the bucket 15) of the front work device 12 is performed on the basis of a result detected by the operation sensor 23*a*. Operations for operating the front implement members of the front work device 12 are boom raising, boom lowering, arm crowding, arm dumping, bucket crowding, and bucket dumping operations.

In step S110, when all of operation levers 23 of the front implement members constituting the front work device 12 are in the dead band, the sub-controller 26 determines that no operation for operating the front work device 12 is performed. The sub-controller 26 then proceeds to step S123. In step S110, when one of the operation levers 23 of the front implement members constituting the front work device 12 is operated beyond the dead band, the sub-controller 26 determines that an operation for operating the front work device 12 is performed. The sub-controller 26 then proceeds to step S135.

In step S123, the sub-controller 26 performs processing of measuring time by the first timer, that is, timer count-up processing of adding a time Δt corresponding to the control cycle to the measured time T1 (T1=T1+ΔT). The sub-controller 26 then proceeds to S125.

In step S125, the sub-controller 26 determines whether or not the time T1 measured by the first timer is equal to or more than the predetermined time Tt1. When the measured time T1 is less than the predetermined time Tt1 in step S125, the processing proceeds to step S127. In step S127, the sub-controller 26 determines that the auto idle condition is not satisfied, and outputs the auto idle clearing command. The sub-controller 26 then returns to step S110. When the measured time T1 is equal to or more than the predetermined time Tt1 in step S125, the processing proceeds to step S130.

In step S130, the sub-controller 26 determines that the auto idle condition is satisfied, and outputs the auto idle activating command. The sub-controller 26 then ends the processing shown in the flowchart of FIG. 4. Incidentally, when the auto idle condition is satisfied, and the auto idle activating command is output, the engine controller 27 performs auto idle control that adjusts the engine revolution speed to a predetermined idle revolution speed.

When it is determined in step S110 that there is an operation of the front implement members, the processing proceeds to step S135. In step S135, the sub-controller 26 determines that the auto idle condition is not satisfied, and outputs the auto idle clearing command and resets the first timer (T1=0). The sub-controller 26 then ends the processing shown in the flowchart of FIG. 4.

Figure 5:
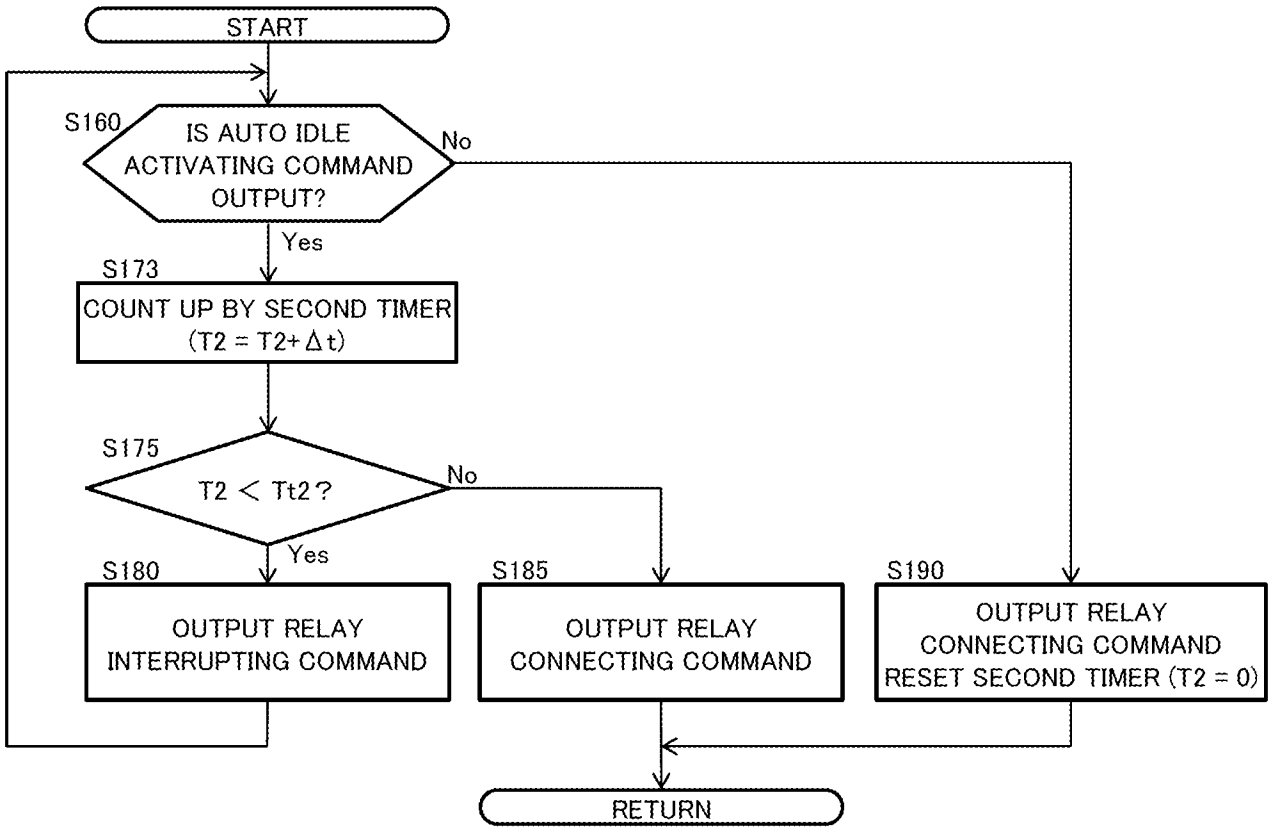
FIG. 5 is a flowchart illustrating an example of processing contents of relay control by the sub-controller in the hydraulic excavator according to the first embodiment.

FIG. 5 is a flowchart illustrating an example of processing contents of control of the relay by the sub-controller 26 in the hydraulic excavator 1 according to the first embodiment. The processing shown in this flowchart is, for example, started by turning on the ignition switch not shown, and is repeatedly performed in a predetermined control cycle after an initial setting not shown is made.

In step S160, the sub-controller 26 determines whether or not the auto idle activating command is output. When it is determined in step S160 that the auto idle activating command is output, the processing proceeds to step S173. When it is determined in step S160 that the auto idle activating command is not output, the processing proceeds to step S190.

In step S173, the sub-controller 26 performs processing of measuring time by the second timer, that is, timer count-up processing of adding a time Δt corresponding to the control cycle to the measured time T2 (T2=T2+Δt). The sub-controller 26 then proceeds to step S175.

In step S175, the sub-controller 26 determines whether or not the time T2 measured by the second timer is less than the predetermined time Tt2. When the measured time T2 is less than the predetermined time Tt2 in step S175, the processing proceeds to step S180. In step S180, the sub-controller 26 outputs a relay interrupting command. The sub-controller 26 then returns to step S160.

When the measured time T2 is equal to or more than the predetermined time Tt2 in step S175, the processing proceeds to step S185. In step S185, the sub-controller 26 outputs a relay connecting command. The sub-controller 26 then ends the processing shown in the flowchart of FIG. 5. Incidentally, when it is determined in step S160 that the auto idle activating command is not output, the processing proceeds to step S190. In step S190, the sub-controller 26 outputs the relay connecting command, and resets the second timer (T2=0). The sub-controller 26 then ends the processing shown in the flowchart of FIG. 5.

As described above, in the present embodiment, when the auto idle condition is satisfied, the auto idle activating command is output from the sub-controller 26, the engine controller 27 performs the auto idle control, and the relay interrupting command is output from the sub-controller 26 and the relay 28 is thereby set in the interrupting state until the predetermined time Tt2 passes after the auto idle activating command is output. Thus, the supply of power from the battery 21 to the main controller 24 is interrupted, so that all of the functions of the main controller 24 are stopped.

Then, when the predetermined time Tt2 passes after the auto idle activating command is output, the relay connecting command is output from the sub-controller 26, and the relay 28 is thereby set in a connecting state. Consequently, power is supplied from the battery 21 to the main controller 24. Therefore, the main controller 24 performs self-diagnosis, and thereafter makes a transition to a normal control state.

A period from activation of the engine 20 by the ignition switch to stopping of the engine 20 (that is, a period from power-on to power-off) in the work machine such as the hydraulic excavator 1 is longer than that of a vehicle intended to transport humans and freight, such as an automobile. With the work machine, there are often situations in which, for example, operators are changed while the engine 20 is kept running, and work is resumed, or a break is taken while the engine 20 is kept running in order to maintain air conditioning or the temperature of the hydraulic operating fluid and work is resumed directly on a site in a harsh environment such as a cold region. In addition, in a case in which an unmanned operation technology is applied to the work machine, a situation is expected in which work is continued for hours until a fuel is replenished.

Hence, there is a problem of fewer opportunities for self-diagnosis when the work machine is configured to perform the self-diagnosing function of the main controller 24 only at a time of turning on power. According to the present embodiment, when operators are changed while the engine 20 is kept running and when an operator takes a break while the engine 20 is kept running, the auto idle condition is satisfied, and therefore opportunities for self-diagnosis of the main controller 24 can be increased. In addition, the auto idle condition is not satisfied when work using the front work device 12 is performed in a state in which the track structure 10 is stopped. That is, the main controller 24 is not restarted at a time of a stop of the track structure 10, and therefore the work of the front work device 12 is not hindered. That is, according to the present embodiment, it is possible to provide the hydraulic excavator 1 in which self-diagnosis of the main controller 24 can be performed at an appropriate frequency without decreasing efficiency of work using the front work device 12.

The foregoing first embodiment has the following actions and effects.

(1) The main controller (first controller) 24 has a self-diagnosing function of diagnosing the presence or absence of a failure in itself (the main controller 24) when the supply of power to itself (the main controller 24) is started. The sub-controller (second controller) 26 performs power interruption control that interrupts the supply of power from the battery 21 to the main controller 24 by outputting the interruption signal to the relay (power interrupting unit) 28 in case the auto idle condition is satisfied, and performs power supply control that starts the supply of power to the main controller 24 afterward (after the passage of the predetermined time Tt2) by outputting the conduction signal to the relay (power interrupting unit) 28.

According to such a present embodiment, it is possible to provide the hydraulic excavator 1 in which self-diagnosis of the main controller 24 can be performed at an appropriate frequency without decreasing the efficiency of work using the front work device 12. As a result, reliability of the hydraulic excavator 1 can be maintained for a long period.

Second Embodiment

Figure 6:
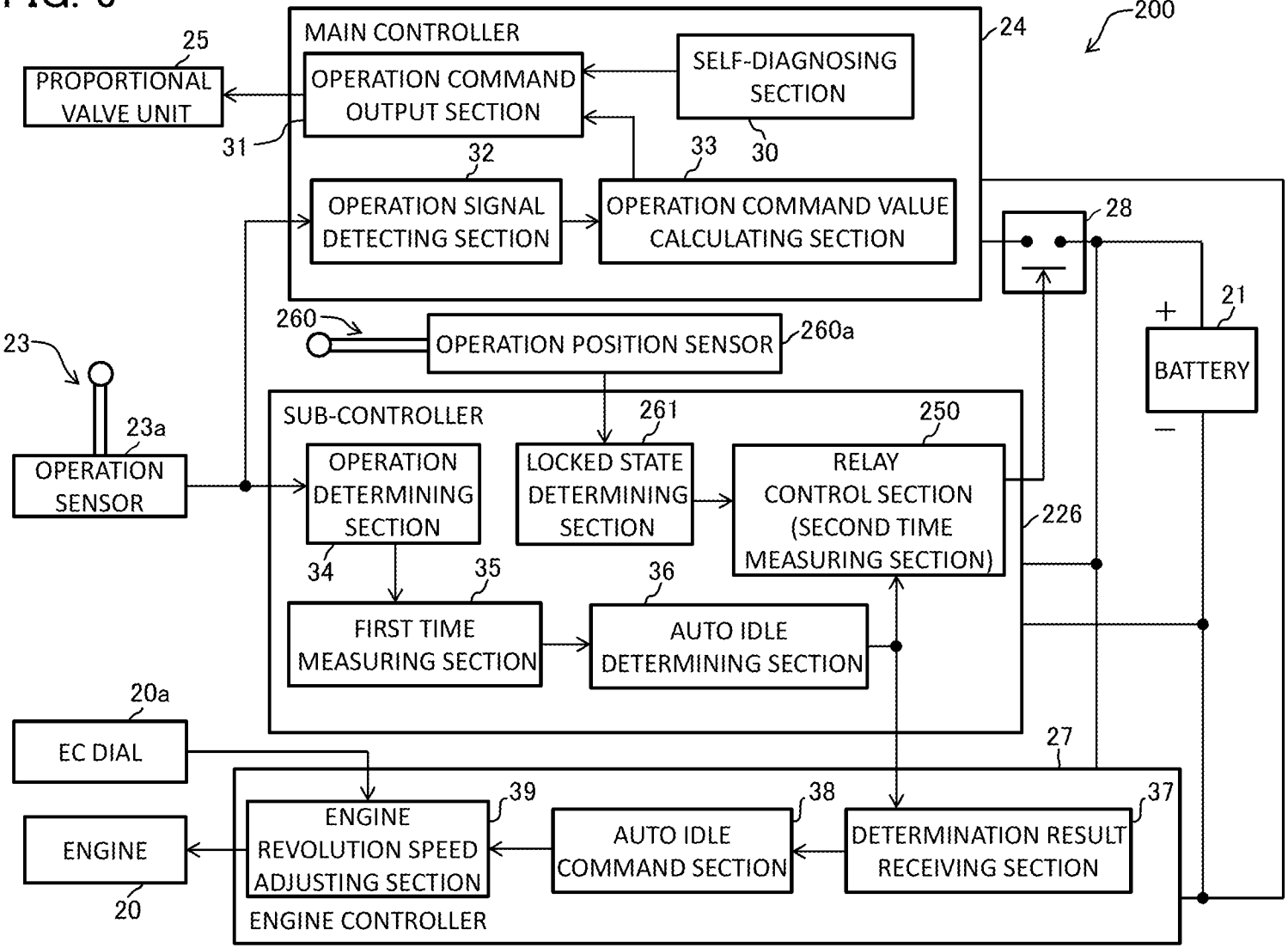
FIG. 6 is a functional block diagram of assistance in explaining a configuration of a control system of a hydraulic excavator according to a second embodiment.

A control system 200 of a hydraulic excavator 1 according to a second embodiment will be described with reference to FIG. 6 and FIG. 7. Incidentally, in the figures, parts identical to or corresponding to those of the first embodiment are identified by the same reference numerals, and differences will be mainly described. FIG. 6 is a diagram similar to FIG. 2, and is a functional block diagram of assistance in explaining a configuration of the control system 200 of the hydraulic excavator 1 according to the second embodiment.

As shown in FIG. 6, the hydraulic excavator 1 according to the second embodiment has a configuration similar to that of the first embodiment, and further includes a shutoff lever (referred to also as a gate lock lever) 260. The shutoff lever 260 is provided within the cab 22 of the hydraulic excavator 1. The shutoff lever 260 is selectively operable to a lowered position that limits an entrance to the cab 22 (lock release position) and a raised position that opens the entrance to the cab 22 (lock position).

When the shutoff lever 260 is operated to the lock position (raised position), a locked state is set in which a hydraulic circuit between the proportional valve unit 25 and the pilot pump is interrupted, and the driving of each hydraulic actuator of the front work device 12 is prohibited. Hence, during the locked state, the hydraulic actuator is not actuated even when the operation lever 23 is operated. When the shutoff lever 260 is operated to the lock release position (lowered position), an unlocked state is set in which the interruption of the hydraulic circuit between the proportional valve unit 25 and the pilot pump is cleared, and the driving of each actuator of the front work device 12 is permitted. Hence, during the unlocked state, the hydraulic actuator is actuated on the basis of an operation of the operation lever 23. That is, the shutoff lever 260 functions as a lock operation device selectively operated to the lock release position in which operation of the operation lever 23 is enabled and the lock position in which operation of the operation lever 23 is disabled. The shutoff lever 260 is provided with an operation position sensor 260*a* that detects the operation position (lock position/lock release position) of the shutoff lever 260, and outputs a detection signal to the sub-controller 26.

The sub-controller 26 includes a locked state determining section 261 that determines whether or not the hydraulic excavator 1 is in the locked state on the basis of the detection signal from the operation position sensor 260*a*. In other words, the locked state determining section 261 is an operation position determining section that detects whether or not the shutoff lever 260 is operated to the lock position. When a signal indicating that the shutoff lever 260 is operated to the lock position is input from the operation position sensor 260*a* to the sub-controller 26, the locked state determining section 261 determines that the hydraulic excavator 1 is in the locked state. When a signal indicating that the shutoff lever 260 is operated to the lock release position is input from the operation position sensor 260*a* to the sub-controller 26, the locked state determining section 261 determines that the hydraulic excavator 1 is not in the locked state, that is, is in the unlocked state.

A relay control section 250 has the following function in addition to the functions of the above-described relay control section 50. The relay control section 250 does not perform the above-described power interruption control when the locked state determining section 261 determines that the hydraulic excavator 1 is in the unlocked state, that is, when the shutoff lever 260 is operated to the lock release position, even when the auto idle condition is satisfied and the auto idle activating command is output.

Figure 7:
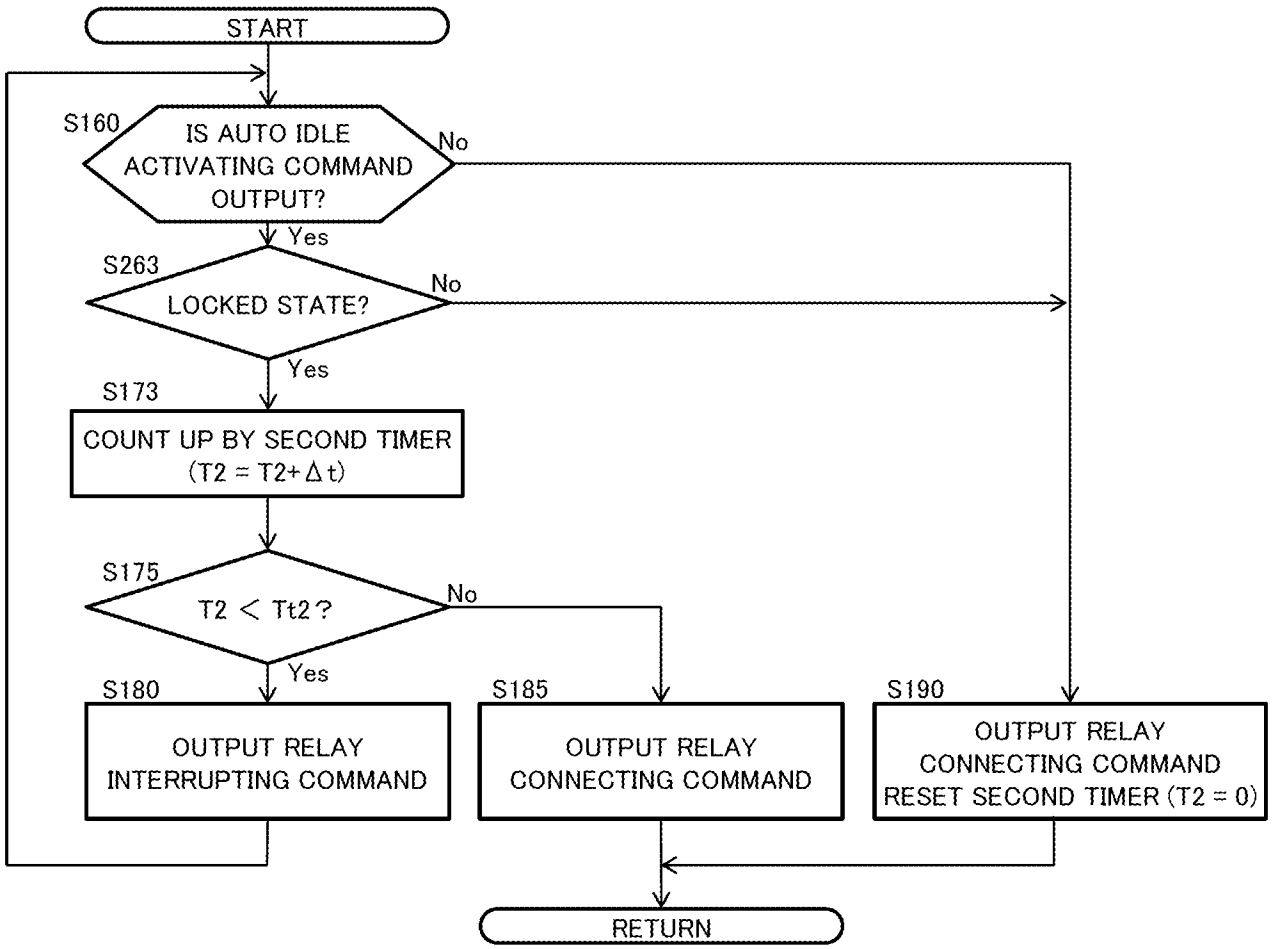
FIG. 7 is a flowchart illustrating an example of processing contents of relay control by a sub-controller in the hydraulic excavator according to the second embodiment.

FIG. 7 is a flowchart illustrating an example of processing contents of relay control by a sub-controller 226 in the hydraulic excavator 1 according to the second embodiment. In FIG. 7, the processing of step S263 is added between the processing of step S160 and the processing of step S173 in the flowchart of FIG. 5. Incidentally, in FIG. 7, the same processing as the processing of FIG. 5 is identified by the same reference numerals, and parts different from the processing of FIG. 5 will be mainly described. The processing shown in this flowchart is started by turning on the ignition switch not shown, and is repeatedly performed in a predetermined control cycle after an initial setting not shown is made.

When it is determined in step S160 that the auto idle activating command is output, the processing proceeds to step S263. In step S263, the sub-controller 226 determines whether or not the hydraulic excavator 1 is in the locked state. When it is determined that the hydraulic excavator 1 is in the locked state, the processing proceeds to step S173. When it is determined that the hydraulic excavator 1 is not in the locked state (that is, the hydraulic excavator 1 is in the unlocked state), the processing proceeds to step S190.

Hence, in the present second embodiment, when the auto idle condition is satisfied and the hydraulic excavator 1 is in the locked state, the relay interrupting command is output from the sub-controller 226 and thus the relay 28 is set in the interrupting state until the predetermined time Tt2 passes. Consequently, the supply of power from the battery 21 to the main controller 24 is interrupted, so that all of the functions of the main controller 24 are stopped.

Then, when the predetermined time Tt2 passes, the relay connecting command is output from the sub-controller 26, and thus the relay 28 is set in the connecting state. Consequently, power is supplied from the battery 21 to the main controller 24. Therefore, the main controller 24 performs self-diagnosis, and thereafter makes a transition to a normal control state.

Such a second embodiment has the following actions and effects in addition to actions and effects similar to those of the foregoing first embodiment.

(2) The hydraulic excavator 1 further includes the shutoff lever (lock operation device) 260 that is selectively operated to the lock release position in which operation of the operation lever (operation device) 23 is enabled and the lock position in which operation of the operation lever (operation device) 23 is disabled. The sub-controller (second controller) 226 does not perform the power interruption control in case the shutoff lever (lock operation device) 260 is operated to the lock release position, even when the auto idle condition is satisfied.

According to such a configuration, the main controller 24 is restarted when the shutoff lever 260 is operated to the lock position (raised position) and the hydraulic excavator 1 is thereby set in the locked state, that is, when the operator explicitly sets a stopped state. It is therefore possible to prevent the main controller 24 from being restarted unintentionally in such a state that the operator temporarily discontinues operating the operation lever 23 although the operator does not have an intention of stopping.

Here, the following problems occur when a configuration is assumed in which the main controller 24 is restarted by temporarily discontinuing operating the operation lever 23 during the unlocked state. With this configuration, even when an operation of the operation lever 23 is performed immediately after interruption of power supply, the front work device 12 may not be able to be operated immediately because the main controller 24 is stopped or being started. That is, since the main controller 24 is restarted after an operation of the operation lever 23 is discontinued temporarily, work cannot be resumed immediately, and thus work efficiency may be degraded. On the other hand, the present second embodiment can prevent the main controller 24 from being restarted unintentionally when an operation of the operation lever 23 is temporarily discontinued. The present second embodiment can therefore improve work efficiency.

Third Embodiment

Figure 8:
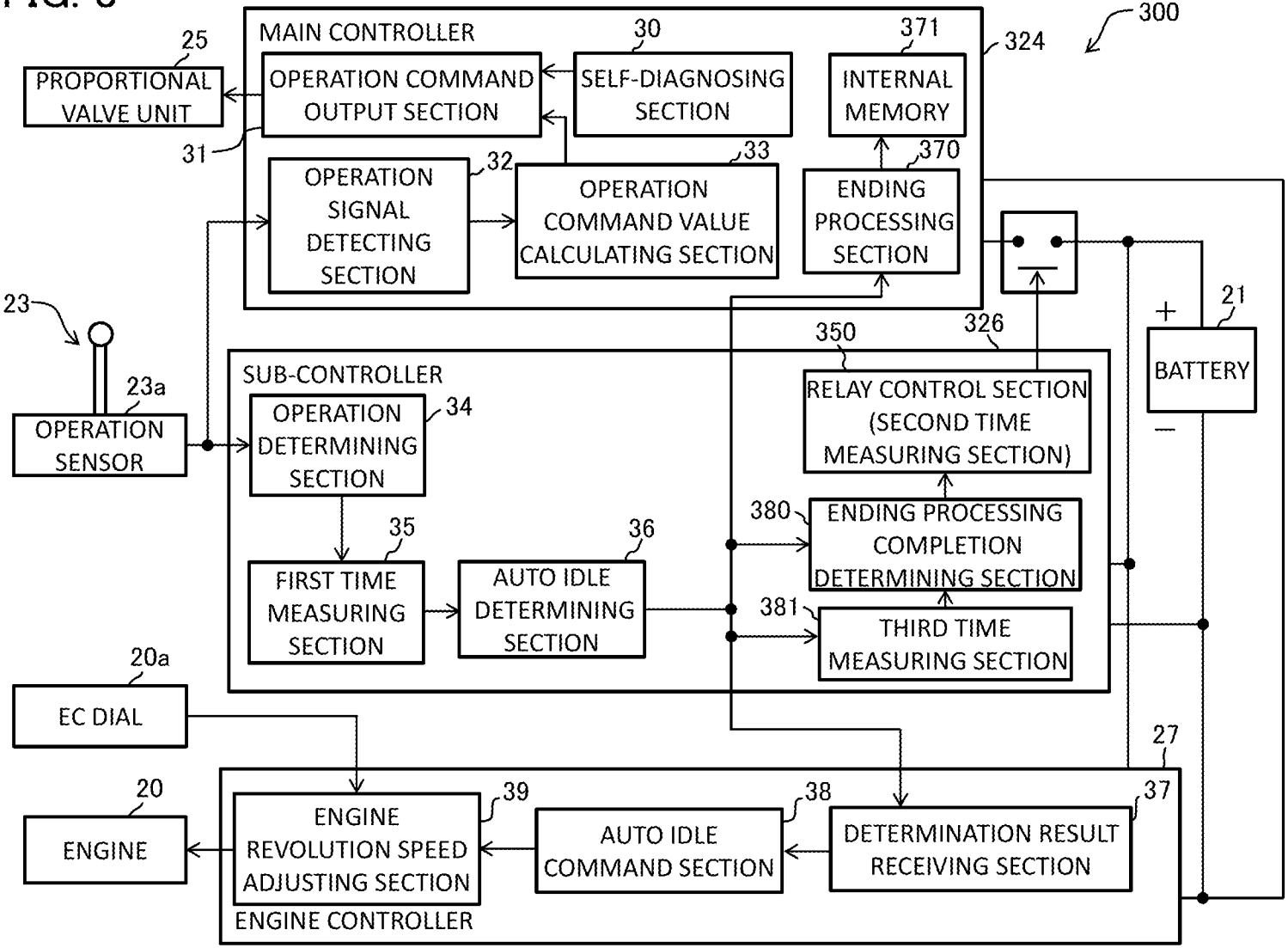
FIG. 8 is a functional block diagram of assistance in explaining a configuration of a control system of a hydraulic excavator according to a third embodiment.

A control system 300 of a hydraulic excavator 1 according to a third embodiment will be described with reference to FIGS. 8 to 10. Incidentally, in the figures, parts identical to or corresponding to those of the first embodiment are identified by the same reference numerals, and differences will be mainly described. FIG. 8 is a diagram similar to FIG. 2, and is a functional block diagram of assistance in explaining a configuration of the control system 300 of the hydraulic excavator 1 according to the third embodiment.

The hydraulic excavator 1 according to the third embodiment has a configuration similar to that of the first embodiment. In the third embodiment, a main controller 324 performs ending processing when the auto idle condition is satisfied, and a sub-controller 326 performs the power interruption control that interrupts the supply of power to the main controller 324 when the auto idle condition is satisfied and it is determined that the ending processing by the main controller 324 is completed. Details will be described in the following.

As shown in FIG. 8, the main controller 324 includes an internal memory 371 as a storage device and an ending processing section 370 that performs the ending processing of storing various kinds of currently set setting values in the internal memory 371. Incidentally, the various kinds of setting values include various setting values such as setting values set by the operator according to own preferences of the operator, for example, setting values for associating the operation levers 23 with the solenoid proportional valves of the proportional valve unit 25 (setting values for associating kinds of hydraulic actuators driven by the operation lever 23 on the right side of the cab seat and kinds of hydraulic actuators driven by the operation lever 23 on the left side of the cab seat), setting values for enabling/disabling various kinds of functions such as an assist function of assisting the operator in operation, and a setting value for correcting the current value obtained from the conversion table used for control of the proportional valve unit 25 or the like.

The ending processing section 370 performs the ending processing when the auto idle determining section 36 determines that the auto idle condition is satisfied and the auto idle activating command is input to the main controller 324. Incidentally, the ending processing section 370 discontinues the ending processing and returns to a normal control state, when the operation lever 23 is operated and the auto idle clearing command is output from the auto idle determining section 36 during a period from a start of the ending processing by the main controller 324 to completion of the ending processing.

The sub-controller 326 includes a third time measuring section 381 that measures a time T3 after the auto idle condition is satisfied and an ending processing completion determining section 380 that determines whether or not the ending processing by the main controller 324 is completed on the basis of a result of determination in the auto idle determining section 36 and a result of measurement in the third time measuring section 381.

The third time measuring section 381 starts measuring time by a third timer included in the sub-controller 326 when the auto idle activating command indicating a result of determining that the auto idle condition is satisfied is output from the auto idle determining section 36. The third time measuring section 381 resets the third timer and sets the measured time T3 to 0 (zero) when the auto idle clearing command indicating a result of determining that the auto idle condition is not satisfied is output from the auto idle determining section 36. That is, the third time measuring section 381 measures a time for which the auto idle condition continues to hold, that is, a time for which the auto idle activating command is continuously output.

The ending processing completion determining section 380 determines that the ending processing by the main controller 324 is not completed when the auto idle clearing command is output from the auto idle determining section 36. In addition, the ending processing completion determining section 380 determines whether or not the time T3 measured by the third time measuring section 381 has passed a predetermined time Tt3. The ending processing completion determining section 380 determines that the ending processing by the main controller 324 is not completed when the time T3 measured by the third time measuring section 381 is less than the predetermined time Tt3. The ending processing completion determining section 380 determines that the ending processing by the main controller 324 is completed when the time T3 measured by the third time measuring section 381 is equal to or more than the predetermined time Tt3. The predetermined time Tt3 is a time obtained by adding a margin time to a time (for example 5s to 10s) taken from a start of the ending processing by the main controller 324 to completion of the ending processing. The predetermined time Tt3 is a threshold value set by experiment or the like. The predetermined time Tt3 is stored in the storage device of the sub-controller 326 in advance.

A relay control section 350 has the following functions in addition to the functions of the above-described relay control section 50. The relay control section 350 outputs the interruption signal to the relay 28 when the ending processing completion determining section 380 determines that the ending processing by the main controller 324 is completed. The relay 28 is thereby set in the interrupting state. The relay control section 350 outputs a connection signal to the relay 28 after the passage of the predetermined time Tt2 from the output of the interruption signal. The relay 28 is thereby set in the connecting state. Incidentally, the relay control section 350 outputs the connection signal to the relay 28 when the ending processing completion determining section 380 determines that the ending processing by the main controller 324 is not completed.

Figure 9:
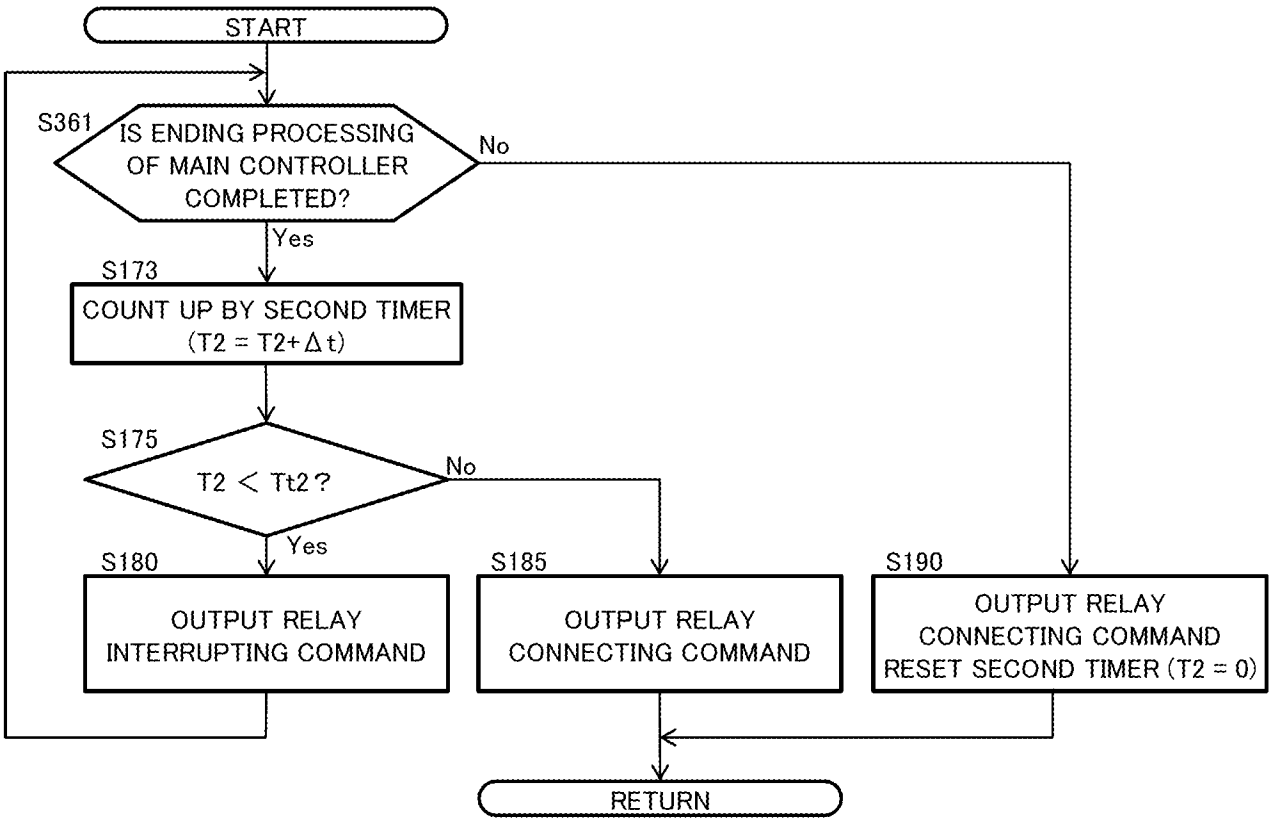
FIG. 9 is a flowchart illustrating an example of processing contents of relay control by a sub-controller in the hydraulic excavator according to the third embodiment.

FIG. 9 is a flowchart illustrating an example of processing contents of relay control by the sub-controller 326 in the hydraulic excavator 1 according to the third embodiment. In FIG. 9, the processing of step S361 is performed in place of the processing of step S160 in the flowchart of FIG. 5. Incidentally, in FIG. 9, the same processing as the processing of FIG. 5 is identified by the same reference numerals, and parts different from the processing of FIG. 5 will be mainly described. The processing shown in this flowchart is started by turning on the ignition switch not shown, and is repeatedly performed in a predetermined control cycle after an initial setting not shown is made.

In step S361, the sub-controller 326 determines whether or not the ending processing by the main controller 324 is completed. When it is determined in step S361 that the ending processing is completed, the processing proceeds to step S173. When it is determined in step S361 that the ending processing is not completed, the processing proceeds to step S190.

Figure 10:
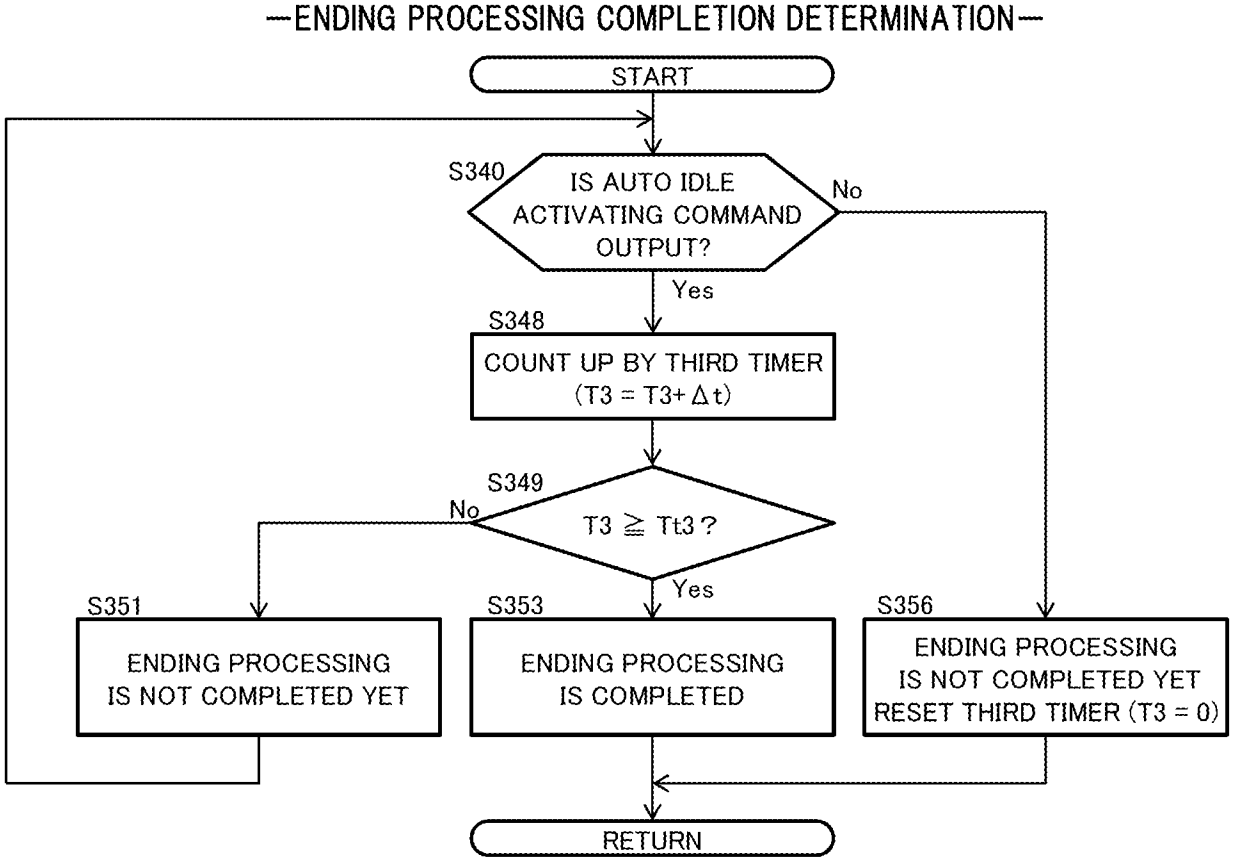
FIG. 10 is a flowchart illustrating an example of processing contents for determining whether or not the ending processing by a main controller is completed.

Incidentally, whether or not the ending processing is completed is made according to the flowchart of ending processing completion determination processing shown in FIG. 10. FIG. 10 is a flowchart illustrating an example of processing contents for determining whether or not the ending processing by the main controller 324 is completed. The ending processing completion determination processing by the sub-controller 326 will be described with reference to FIG. 10. In step S340, the sub-controller 326 determines whether or not the auto idle activating command is output. When the sub-controller 326 determines in step S340 that the auto idle activating command is output, the sub-controller 326 proceeds to step S348. When the sub-controller 326 determines in step S340 that the auto idle activating command is not output, the sub-controller 326 proceeds to step S356.

In step S348, the sub-controller 326 performs processing of measuring time by the third timer, that is, timer count-up processing of adding a time Δt corresponding to the control cycle to the measured time T3 (T3=T3+ΔT). The sub-controller 326 then proceeds to step S349.

In step S349, the sub-controller 326 determines whether or not the time T3 measured by the third timer is equal to or more than the predetermined time Tt3. When the measured time T3 is less than the predetermined time Tt3 in step S349, the processing proceeds to step S351, where it is determined that the ending processing is not completed. The processing then returns to step S340.

When the measured time T3 is equal to or more than the predetermined time Tt3 in step S349, the processing proceeds to step S353, where it is determined that the ending processing is completed. The processing shown in the flowchart of FIG. 10 is then ended. Incidentally, when it is determined in step S340 that the auto idle activating command is not output, the processing proceeds to step S356. In step S356, the sub-controller 326 determines that the ending processing by the main controller 324 is not completed, and resets the third timer (T3=0). The sub-controller 326 then ends the processing shown in the flowchart of FIG. 10.

As described above, in the present third embodiment, when the auto idle condition is satisfied and the auto idle activating command is input to the main controller 324, the main controller 324 performs the ending processing. The sub-controller 326 determines whether or not the ending processing by the main controller 324 is completed according to the processing of the flowchart of FIG. 10, and controls the relay 28 according to the processing of the flowchart of FIG. 9 on the basis of a result of the determination.

Such a third embodiment has the following actions and effects in addition to actions and effects similar to those of the foregoing first embodiment.

(3) The main controller (first controller) 324 performs the ending processing when the auto idle condition is satisfied, and the sub-controller (second controller) 326 determines whether or not the ending processing by the main controller 324 (first controller) is completed, and performs the power interruption control in case the auto idle condition is satisfied and it is determined that the ending processing by the main controller (first controller) 324 is completed. Incidentally, in the present third embodiment, the sub-controller (second controller) 326 determines that the ending processing by the main controller (first controller) 324 is completed when the time T3 after the auto idle condition is satisfied has passed the predetermined time Tt3, and performs the power interruption control.

Thus, the main controller 324 can store various kinds of setting values in the internal memory 371 before the supply of power to the main controller 324 is interrupted. Therefore, the setting values can be prevented from being initialized after a restart due to the interruption of the power supply before completion of the ending processing in the main controller 324. According to the present embodiment, the settings before the supply of power to the main controller 324 is interrupted can be taken over even after a restart. As a result, operation characteristics of the hydraulic excavator 1 according to operation of the operator can be prevented from changing between before and after a restart of the main controller 324.

Fourth Embodiment

Figure 11:
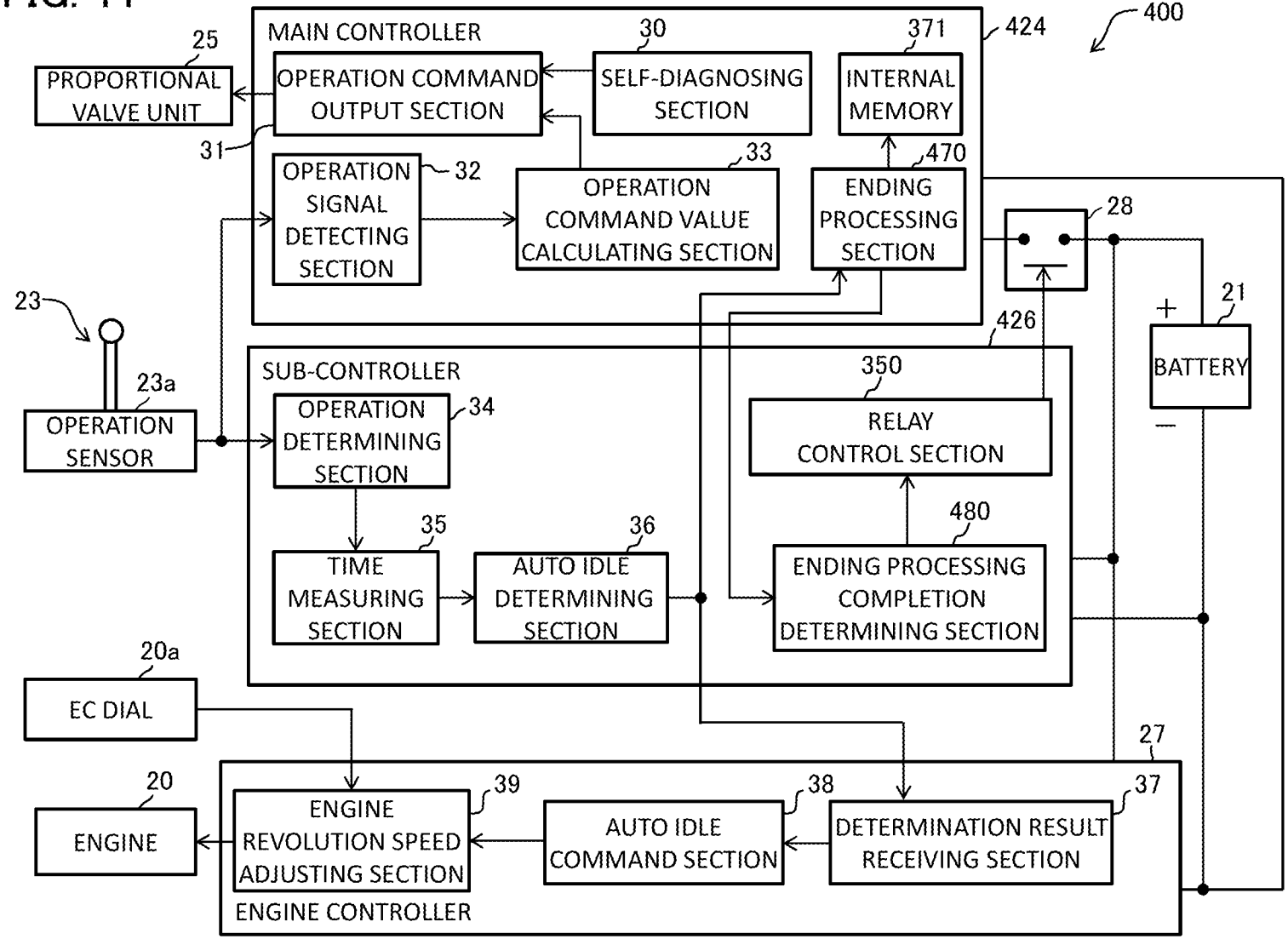
FIG. 11 is a functional block diagram of assistance in explaining a configuration of a control system of a hydraulic excavator according to a fourth embodiment.

A control system 400 of a hydraulic excavator 1 according to a fourth embodiment will be described with reference to FIG. 11. Incidentally, in the figures, parts identical to or corresponding to those of the third embodiment are identified by the same reference numerals, and differences will be mainly described. FIG. 11 is a diagram similar to FIG. 8, and is a functional block diagram of assistance in explaining a configuration of the control system 400 of the hydraulic excavator 1 according to the fourth embodiment.

In the third embodiment, description has been made of an example in which the sub-controller 326 determines that the ending processing by the main controller 324 is completed when the time T3 from a start of output of the auto idle activating command (that is, a time after the auto idle condition is satisfied) has passed the predetermined time Tt3, and sets the relay 28 in the interrupting state. In the present fourth embodiment, on the other hand, a sub-controller 426 determines that the ending processing by a main controller 424 is completed when a signal indicating that the ending processing is completed is input from the main controller 424, and sets the relay 28 in the interrupting state. Details will be described in the following.

An ending processing section 470 of the main controller 424 performs ending processing similar to that of the ending processing section 370 according to the foregoing third embodiment. In addition, the ending processing section 470 outputs a signal indicating that the ending processing is not completed (ending processing noncompletion notification) to the sub-controller 426 when the ending processing is not completed. The ending processing section 470 outputs a signal indicating that the ending processing is completed (ending processing completion notification) to the sub-controller 426 when the ending processing is completed. Incidentally, when the operation lever 23 is operated and the auto idle clearing command is output from the auto idle determining section 36 during a period from a start of the ending processing by the main controller 424 to completion of the ending processing, the ending processing section 470 discontinues the ending processing, returns to a normal control state, and outputs the ending processing noncompletion notification to the sub-controller 426.

An ending processing completion determining section 480 of the sub-controller 426 determines whether or not the ending processing by the main controller 424 is completed on the basis of a signal (ending processing completion notification/ending processing noncompletion notification) from the main controller 424. The ending processing completion determining section 480 determines that the ending processing by the main controller 424 is completed when a signal indicating that the ending processing is completed (ending processing completion notification) is input from the ending processing section 470 of the main controller 424. The ending processing completion determining section 480 determines that the ending processing by the main controller 424 is not completed when a signal indicating that the ending processing is not completed (ending processing noncompletion notification) is input from the ending processing section 470.

As in the foregoing third embodiment, the relay control section 350 outputs the interruption signal to the relay 28 when the ending processing completion determining section 480 determines that the ending processing by the main controller 424 is completed. The relay 28 is thereby set in the interrupting state. The relay control section 350 outputs the connection signal to the relay 28 after the predetermined time Tt2 has passed from the output of the interruption signal. The relay 28 is thereby set in the connecting state. Incidentally, the relay control section 350 outputs the connection signal to the relay 28 when the ending processing completion determining section 480 determines that the ending processing by the main controller 324 is not completed.

In the present fourth embodiment, the sub-controller 426 determines in step S361 shown in FIG. 9 that the ending processing by the main controller 424 is completed when the ending processing completion notification is output from the main controller 424. The sub-controller 426 then proceeds to step S173. In step S361, the sub-controller 426 determines that the ending processing by the main controller 424 is not completed when the ending processing completion notification is not output from the main controller 424 (that is, when the ending processing noncompletion notification is output from the main controller 424). The sub-controller 426 then proceeds to step S190.

As described above, in the present fourth embodiment, when the auto idle condition is satisfied and the auto idle activating command is input to the main controller 424, the main controller 424 performs the ending processing. Then, when the ending processing is completed, the ending processing completion notification is output from the main controller 424 to the sub-controller 426, and the relay 28 is controlled according to the processing of the flowchart of FIG. 9.

Such a fourth embodiment has the following actions and effects in addition to actions and effects similar to those of the foregoing third embodiment.

(4) The sub-controller (second controller) 426, when a signal indicating that the ending processing is completed (ending processing completion notification) is input from the main controller (first controller) 424, determines that the ending processing by the main controller 424 is completed, and performs the power interruption control. Thus, the interruption of the supply of power to the main controller 424 before completion of the ending processing can be prevented more reliably. That is, the fourth embodiment can more effectively avoid a problem that appropriate setting values are not stored in the internal memory 371 and an unexpected operation occurs at a time of a restart.

The following modifications are also within the scope of the present invention. It is possible to combine a configuration illustrated in a modification and a configuration described in a foregoing embodiment with each other, combine configurations described in foregoing different embodiments with each other, or combine configurations described in following different modifications with each other.

First Modification

Each of the controllers 24, 26, and 27 can be constituted by a plurality of microcomputers. In addition, instead of providing the sub-controller 26 and the engine controller 27 separately from each other, one controller having the functions of the sub-controller 26 and the engine controller 27 may be provided.

Second Modification

In the foregoing embodiments, description has been made of an example in which the front work device 12 is constituted by the boom 13, the arm 14, and the bucket 15. However, the present invention is not limited to this. The structure, the number of joints, and the like of the work device can be configured arbitrarily. For example, a grapple that holds an object by being hydraulically opened and closed may be provided in place of the bucket 15.

Third Modification

The main controller 24, 324, or 424 may not only control each of the hydraulic cylinders 16, 17, and 18 of the front work device 12 but also control an on-off control valve that interrupts and opens a hydraulic circuit by using an I/O digital output port included in the main controller 24, 324, or 424.

Fourth Modification

In the foregoing embodiments, description has been made of an example in which the operation signal detected by the operation sensor 23*a* is voltage. However, the present invention is not limited to this. It suffices for the operation sensor 23*a* and the operation determining section 34 to be of a configuration in which the operation determining section 34 can determine the presence or absence of operation of the operation lever 23 on the basis of a result of detection in the operation sensor 23*a*. For example, the operation signal output from the operation sensor 23*a* may be a digital signal or a PWM signal, and the operation determining section 34 may determine the presence or absence of operation of the operation lever 23 on the basis of these operation signals. In addition, the type of the operation lever 23 is not limited to an electric lever type, but a hydraulic lever type may be used. In this case, it suffices to provide a pressure sensor to a pilot circuit that hydraulically transmits the operation signal, and use a detected pressure as the operation signal.

Fifth Modification

The conversion table (see FIG. 3) between the voltage value and the current value as described in the foregoing embodiments is a mere example. The table may be changed optionally according to operation characteristics of the hydraulic actuator.

Sixth Modification

The configuration of the control system 100, 200, 300, or 400 described in the foregoing embodiments is a mere example. Various configurations can be adopted as the configuration as long as the configurations enable a device (not shown) independent from the main controller 24, 324, or 424 to receive a command from the sub-controller 26, 226, 326, or 426, and control the supply of power to the main controller 24, 324, or 424. For example, in the first embodiment, the battery 21 that supplies power to each of the controllers 24, 26, and 27 may be separately provided to each of the controllers 24, 26, and 27.

Seventh Modification

In the foregoing embodiments, description has been made of an example in which the relay 28 is provided as a power interrupting unit that can interrupt the supply of power from the battery 21 to the main controller 24, 324, or 424, and the supply of power to the main controller 24, 324, or 424 is controlled by controlling the opening and closing of the relay 28. However, the present invention is not limited to this. For example, a configuration may be adopted in which power is supplied from the battery 21 to the main controller 24, 324, or 424 via the sub-controller 26, 226, 326, or 426, a power interrupting unit such as a switch circuit may be provided within the sub-controller 26, 226, 326, or 426 in place of the relay 28, and the supply of power from the battery 21 to the main controller 24, 324, or 424 may be interrupted by controlling the power interrupting unit. In addition, another controller (not shown) than the main controller 24, 324, or 424 may be provided in place of the relay 28, and the other controller may directly supply power to the main controller 24, 324, or 424 or interrupt the power to the main controller 24, 324, or 424.

Eighth Modification

In the foregoing embodiments, description has been made of an example in which the auto idle condition is satisfied when the operation lever 23 is not operated for a predetermined time. However, the present invention is not limited to this. For example, a configuration may be adopted in which operation signals of not only the operation lever 23 for operating the front work device 12 but also a travelling pedal (not shown) for operating the travelling of the track structure 10 are detected, and when neither of the operation signals of the operation lever 23 and the travelling pedal is detected for a predetermined time, it is determined that the auto idle condition is satisfied, and the auto idle control is performed.

Ninth Modification

In the foregoing embodiments, description has been made of an example in which when the auto idle condition is satisfied, auto idling control of the engine controller 27 is performed, and the main controller 24, 324, or 424 is restarted. However, the present invention is not limited to this. The auto idle control may not be performed when a predetermined condition is satisfied even when the above-described auto idle condition is satisfied and the auto idle activating command is output from the sub-controller 26, 226, 326, or 426 to the engine controller 27. For example, the engine controller 27, even when the auto idle activating command is input to the engine controller 27, may warm up the engine 20 by exceptionally performing control that maintains the engine revolution speed at a revolution speed higher than the idle revolution speed when a cooling water temperature is lower than a predetermined threshold value. Even in such a case, the sub-controller 26, 226, 326, or 426 performs the power interruption control that interrupts the supply of power to the main controller 24, 324, or 424 when the auto idle condition is satisfied.

Tenth Modification

The foregoing embodiments have been described by taking the crawler type track structure (track device) 10 as an example. However, the present invention is not limited to this. The present invention can also be applied to a work machine having a wheeled track structure (track device) such as a wheeled hydraulic excavator or a wheel loader.

Eleventh Modification

In the foregoing second embodiment, the shutoff lever 260 is used as a lock operation device. However, the present invention is not limited to this. It suffices for the lock device to be a device that can select enabling/disabling of operation of the operation lever 23, such as a device that can interrupt a signal from the main controller 24, 324, or 424 to the proportional valve unit 25, a device that can interrupt a signal (pilot pressure) from the proportional valve unit 25 to the control valve, or a device that can interrupt the hydraulic circuit between the proportional valve unit 25 and the pilot pump. For example, a pilot cut switch provided within the cab of a wheeled hydraulic excavator that can travel on a public road also has functions equivalent to those of the shutoff lever, and therefore the pilot cut switch may be used as the lock device.

Twelfth Modification

In the foregoing third and fourth embodiments, description has been made of an example in which the ending processing performed by the main controller 324 or 424 stores various kinds of setting values in the internal memory 371. However, the present invention is not limited to this. It suffices for the ending processing performed by the main controller 324 or 424 to be special processing performed only at an ending time (when the power to the main controller 324 or 424 is turned off). The ending processing may, for example, be processing of storing various kinds of setting values and a result of failure diagnosis (failure information or the like) in the sub-controller 326 or 426 outside the main controller 324 or 424 or an external apparatus such as an external server at an ending time.

Thirteenth Modification

In addition, as described above, configurations described in different embodiments may be combined with each other. For example, the shutoff lever 260 and the locked state determining section 261 in the second embodiment may be incorporated into the control system 300 or 400 in the third embodiment or the fourth embodiment, the ending processing by the main controller 324 or 424 may be performed only when the hydraulic excavator 1 is in the locked state, and the power interruption control that interrupts the supply of power to the main controller 324 or 424 may be performed when it is determined that the ending processing is completed in the locked state.

Fourteenth Modification

Description has been made of an example in which the battery 21 is provided as a power supply source. However, the present invention is not limited to this. The power supply source that supplies power to the main controller 24, 324, or 424 may be an electrical storage device such as a capacitor, or may be a generator.

Embodiments of the present invention have been described above. However, the foregoing embodiments merely represent a part of examples of application of the present invention, and are not intended to limit the technical scope of the present invention to the specific configurations of the foregoing embodiments.

DESCRIPTION OF REFERENCE CHARACTERS

1: Hydraulic excavator (work machine)
12: Front work device (work device)
20: Engine
23: Operation lever (operation device)
24, 324, 424: Main controller (first controller)
26, 226, 326, 426: Sub-controller (second controller)
27: Engine controller (second controller)
260: Shutoff lever (lock operation device)

The invention claimed is:

1. A work machine comprising:

a work device;

an operation lever operating the work device;

a main controller configured to control operation of the work device on a basis of operation of the operation lever, and diagnose presence or absence of a failure in the main controller when supply of power from a battery is started;

a relay provided to a power line that connects the battery and a power supply circuit of the main controller to each other;

an engine controller configured to perform auto idle control that decreases an engine revolution speed to an idle revolution speed when an auto idle activating command is input; and a sub-controller configured to determine that an auto idle condition is satisfied in case the operation lever is not operated for a first time and output the auto idle activating command to the engine controller when the auto idle condition is satisfied, wherein when a conduction signal is input from the sub-controller to the relay, the relay is set in a conduction state, and permits the supply of power from the battery to the main controller, when an interruption signal is input from the sub-controller to the relay, the relay is set in an interrupting state, and interrupts the supply of power from the battery to the main controller, the sub-controller is configured to interrupt the supply of the power from the battery to the main controller by outputting the interruption signal to the relay in case the auto idle condition is satisfied, and start the supply of the power from the battery to the main controller by outputting the conduction signal to the relay when determining that a time after the power supply is interrupted has passed a second time, and the main controller is configured to diagnose presence or absence of the failure in the main controller when the supply of the power from the battery is started.

2. The work machine according to claim 1, further comprising:

a shutoff lever that is selectively operated to a lock release position that enables operation of the operation lever and a lock position that disables operation of the operation lever, wherein the sub-controller, in case the shutoff lever is operated to the lock release position, does not interrupt the supply of the power from the battery to the main controller even when the auto idle condition is satisfied.

3. The work machine according to claim 1, wherein the main controller is configured to perform ending processing when the auto idle condition is satisfied, and the sub-controller is configured to determine whether or not the ending processing by the main controller is completed, interrupt the supply of the power from the battery to the main controller in case the auto idle condition is satisfied and the sub-controller determines that the ending processing by the main controller is completed, and start the supply of the power from the battery to the main controller when the time after the power supply is interrupted has passed the second time.

4. The work machine according to claim 3, wherein the sub-controller is configured to determine that the ending processing by the main controller is completed when a time after the auto idle condition is satisfied has passed a third time.

5. The work machine according to claim 3, wherein the sub-controller is configured to determine that the ending processing by the main controller is completed when a signal indicating that the ending processing is completed is input from the main controller.

* * * * *